US009698487B2

(12) United States Patent
Sudo et al.

(10) Patent No.: US 9,698,487 B2
(45) Date of Patent: Jul. 4, 2017

(54) ARRAY ANTENNA

(71) Applicant: Murata Manufacturing Co., Ltd., Kyoto (JP)

(72) Inventors: Kaoru Sudo, Kyoto (JP); Masayuki Nakajima, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 21 days.

(21) Appl. No.: 14/700,805

(22) Filed: Apr. 30, 2015

(65) Prior Publication Data

US 2015/0236425 A1 Aug. 20, 2015

Related U.S. Application Data

(63) Continuation of application No. PCT/JP2013/078319, filed on Oct. 18, 2013.

(30) Foreign Application Priority Data

Nov. 7, 2012 (JP) ..... 2012-245294
Apr. 17, 2013 (JP) ..... 2013-086510

(51) Int. Cl.
*H01Q 9/42* (2006.01)
*H01Q 21/06* (2006.01)

(52) U.S. Cl.
CPC ..... *H01Q 9/42* (2013.01); *H01Q 21/06* (2013.01)

(58) Field of Classification Search
CPC ... H01Q 9/0407; H01Q 9/0414; H01Q 21/065
See application file for complete search history.

(56) References Cited

U.S. PATENT DOCUMENTS 5,319,377 A * 6/1994 Thomas ..... H01Q 13/085 343/700 MS
5,339,089 A 8/1994 Dienes
(Continued)

FOREIGN PATENT DOCUMENTS

EP 0 487 053 A1 5/1992
JP S51-132058 A 11/1976
(Continued)

OTHER PUBLICATIONS

Machine Translation of KR10-2011--0005452 from Korean Intellectual Property Office.*
(Continued)

*Primary Examiner* — Howard Williams
(74) *Attorney, Agent, or Firm* — Pearne & Gordon, LLP

(57) ABSTRACT

In a multilayer substrate, eight front-side antenna portions and eight back-side antenna portions are disposed. Front-side radiation elements in the front-side antenna portions and back-side radiation elements in the back-side antenna portions are arranged in a staggered pattern when being vertically projected onto an back side of the multilayer substrate. The front-side radiation elements are disposed on a front side of the multilayer substrate, and a front-side ground layer is formed near the back side of the multilayer substrate. On the other hand, the back-side radiation elements are disposed on the back side of the multilayer substrate, and a back-side ground layer is formed near the front side of the multilayer substrate. The front-side radiation element and the back-side radiation element are disposed so as not to overlap each other when being vertically projected onto the back side of the multilayer substrate.

5 Claims, 12 Drawing Sheets

(56) References Cited

U.S. PATENT DOCUMENTS

| | | | | |
|---|---|---|---|---|
| 5,990,836 | A * | 11/1999 | Bhattacharyya | H01Q 5/42 343/700 MS |
| 6,956,536 | B2 * | 10/2005 | Lee | H01Q 1/38 343/700 MS |
| 2007/0052593 | A1 | 3/2007 | Bateman | |
| 2010/0066631 | A1 | 3/2010 | Puzella | |
| 2010/0167666 | A1 | 7/2010 | Choudhury | |
| 2011/0025574 | A1 | 2/2011 | Tiezzi | |
| 2011/0193761 | A1 | 8/2011 | Shinkai | |

FOREIGN PATENT DOCUMENTS

| | | | |
|---|---|---|---|
| JP | S54-43446 | A | 4/1979 |
| JP | S55-93305 | A | 7/1980 |
| JP | S60-236303 | A | 11/1985 |
| JP | 2001-119230 | A | 4/2001 |
| JP | 2005-311551 | A | 11/2005 |
| JP | 2006-185371 | A | 7/2006 |
| JP | 2008-005164 | A | 1/2008 |
| JP | 2008-061030 | A | 3/2008 |
| JP | 2012-070237 | A | 4/2012 |
| KR | 2011-0005452 | A | 1/2011 |
| WO | 2004/093240 | A2 | 10/2004 |
| WO | 2010/041436 | A1 | 4/2010 |

OTHER PUBLICATIONS

Extended European Search Report issued in Application No. EP 13 85 2406 dated May 30, 2016.

Office Action issued in Korean Patent Application No. 10-2015-7009536 dated Mar. 15, 2016.

International Search Report issued in Application No. PCT/JP2013/078319 dated Jan. 21, 2014.

Translation of Written Opinion issued in Application No. PCT/JP2013/078319 dated Jan. 21, 2014.

* cited by examiner

ARRAY ANTENNA

BACKGROUND OF THE INVENTION

Field of the Invention

The present disclosure relates to an array antenna including a plurality of antennas formed in a substrate.

Description of the Related Art

Patent Document 1 discloses a microstrip antenna (patch antenna) including a radiation element and a ground layer which face each other across a dielectric having a small thickness relative to a wavelength and a passive element disposed on the radiation surface side of the radiation element. Patent Document 2 discloses an array antenna in which a plurality of antennas are connected by a plurality of transmission lines. Patent Document 3 discloses a configuration in which two or more disc-shaped antennas are coupled in parallel and have directivities in different directions. Patent Document 4 discloses a configuration in which antennas are formed on either side of a substrate.

Patent Document 1: Japanese Unexamined Patent Application Publication No. 55-93305

Patent Document 2: Japanese Unexamined Patent Application Publication No. 2008-5164

Patent Document 3: Japanese Unexamined Patent Application Publication No. 60-236303

Patent Document 4: Japanese Unexamined Patent Application Publication No. 2001-119230

BRIEF SUMMARY OF THE INVENTION

The antennas disclosed in Patent Documents 1 and 2 exhibit low directivity toward an undersurface on which a ground layer is formed and have a narrow communication region. On the other hand, in the configuration disclosed in Patent Document 3 in which a plurality of antennas are oriented in different directions, a wide communication region is obtained. However, these antennas are independent of each other. A device therefore increases in size and has a complicated structure. In an antenna device disclosed in Patent Document 4 in which antennas are formed on both sides of a printed circuit board, ground layers are formed on both sides of the printed circuit board and radiation elements are disposed at the corresponding ground layers. The total thickness of the antenna device is the sum of the thickness of the printed circuit board and the thicknesses of the two antennas. The antenna device therefore increases in thickness and size.

The present disclosure provides a small-sized array antenna having a wide communication region.

(1) In order to solve the above-described problems, an array antenna according to the present disclosure has the following configuration. In an array antenna, a plurality of antennas each having a radiation element are disposed in a substrate. One of an adjacent two of the plurality of antennas has a front-side radiation element on or near a front side of the substrate and forms a front-side antenna portion. The other one of the adjacent two of the plurality of antennas has a back-side radiation element on or near a back side of the substrate and forms a back-side antenna portion. The front-side radiation element in the front-side antenna portion and the back-side radiation element in the back-side antenna portion are arranged so as not to overlap each other when being vertically projected onto the back side of the substrate. As used herein, "near a front side," or the like, means closer to the front side than to the back side and "near a back side" means closer to the back side than the front side.

According to the present disclosure, since a front-side antenna portion including a front-side radiation element disposed on or near the front side of a substrate and a back-side antenna portion including a back-side radiation element disposed on or near the back side of the substrate are provided, both sides of the substrate can have directivity and a communication region can be increased as compared with a case in which only one side of a substrate has directivity. The front-side radiation element in the front-side antenna portion and the back-side radiation element in the back-side antenna portion are disposed so as not to overlap each other when being vertically projected onto the back side of the substrate. Accordingly, the front-side ground layer in the front-side antenna portion can be formed on or near the back side of the substrate and the back-side ground layer in the back-side antenna portion can be formed on or near the front side of the substrate. In order to achieve wider frequency bands of the front-side antenna portion and the back-side antenna portion, it is therefore possible to obtain a large thickness dimension between a ground layer and a radiation element while reducing, or not increasing the thickness dimension of the substrate. As a result, a small-sized array antenna including a substrate having a small thickness dimension can be obtained.

(2) In the array antenna, the substrate is a multilayer substrate, a front-side ground layer facing the front-side radiation element in the front-side antenna portion is formed on or near the back side of the substrate, and a back-side ground layer facing the back-side radiation element in the back-side antenna portion is formed on or near the front side of the substrate.

According to the present disclosure, since the front-side ground layer faces the front-side radiation element, the front-side ground layer and the front-side radiation element can form a patch antenna. Since the back-side ground layer faces the back-side radiation element, the back-side ground layer and the back-side radiation element can form a patch antenna. Since the front-side ground layer is formed on or near the back side of the substrate and the back-side ground layer is formed on or near the front side of the substrate, it is possible to obtain a large thickness dimension between a ground layer and a radiation element while reducing the thickness dimension of the substrate. A patch antenna with a wide frequency band can be obtained. Furthermore, antenna space can be efficiently used and a small-sized array antenna can be obtained.

(3) In the array antenna, a conductor connection portion for electrically connecting the front-side ground layer and the back-side ground layer is disposed in the multilayer substrate to surround the front-side radiation element and the back-side radiation element.

According to the present disclosure, since the conductor connection portion is disposed in the multilayer substrate to surround the front-side radiation element and the back-side radiation element, a wall can be provided between the front-side antenna portion and the back-side antenna portion by the conductor connection portion. It is therefore possible to suppress the mutual interference between the front-side antenna portion and the back-side antenna portion.

(4) In the array antenna, the front-side antenna portion includes a front-side passive element laminated on a front side of the front-side radiation element via an insulating layer and the back-side antenna portion includes a back-side passive element laminated on a back side of the back-side radiation element via an insulating layer.

According to the present disclosure, since the front-side antenna portion includes the front-side passive element laminated on the front side of the front-side radiation element via an insulating layer, a stacked patch antenna in which the front-side radiation element and the front-side passive element are electromagnetically coupled can be provided. The front-side antenna portion therefore have two resonant modes (electromagnetic field modes) for different resonant frequencies and the wider frequency band of the front-side antenna portion can be achieved. For similar reasons, the wider frequency band of the back-side antenna portion can also be achieved.

(5) In the array antenna, when the front-side radiation element in the front-side antenna portion that is one of the adjacent two of the plurality of antennas and the back-side radiation element in the back-side antenna portion that is the other one of the adjacent two of the plurality of antennas are vertically projected onto the back side of the substrate, a gap between the front-side radiation element and the back-side radiation element is set to a predetermined value based on frequencies to be radiated.

According to the present disclosure, when the front-side radiation element and the back-side radiation element are vertically projected onto the back side of the substrate, a gap between them is set to a predetermined value based on frequencies to be radiated. When the gap between the front-side radiation element and the back-side radiation element is small, mutual coupling between the front-side radiation element and the back-side radiation element becomes stronger and the characteristics of the array antenna are adversely affected. On the other hand, when the gap between the front-side radiation element and the back-side radiation element is large, the side lobe is increased and an antenna gain in a front direction is reduced. By setting the gap between the front-side radiation element and the back-side radiation element to a predetermined value, these problems can be avoided.

(6) In the array antenna, when the front-side radiation elements in the front-side antenna portions each of which is one of the adjacent two of the plurality of antennas and the back-side radiation elements in the back-side antenna portions each of which is the other one of the adjacent two of the plurality of antennas are vertically projected onto the back side of the substrate, the front-side radiation elements are arranged in a staggered pattern and the back-side radiation elements are arranged in a staggered pattern.

According to the present disclosure, when the front-side radiation elements and the back-side radiation elements are vertically projected onto the back side of the substrate, the front-side radiation elements are arranged in a staggered pattern and the back-side radiation elements are arranged in a staggered pattern. Accordingly, the area usage efficiency of the substrate is increased and the array antenna can be reduced in size.

DETAILED DESCRIPTION OF THE INVENTION

Figure 1:
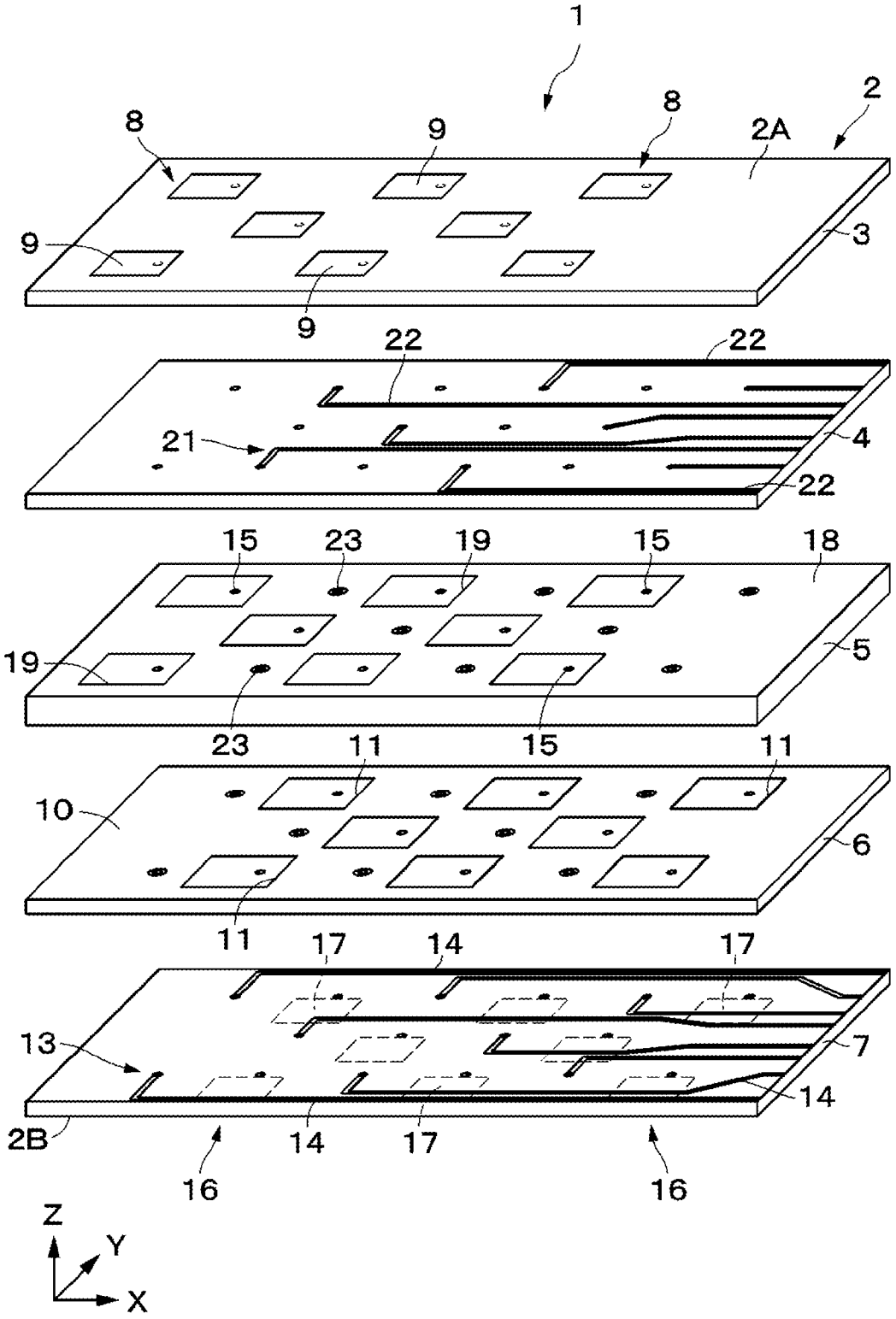
FIG. 1 is an exploded perspective view of an array antenna according to a first embodiment of the present disclosure.

An array antenna according to an embodiment of the present disclosure will be described in detail below with reference to the accompanying drawings.

An array antenna 1 according to a first embodiment of the present disclosure is illustrated in FIGS. 1 to 5. The array antenna 1 includes a multilayer substrate 2, a front-side antenna portion 8, and a back-side antenna portion 16.

The multilayer substrate 2 is formed in a flat shape parallel to the X-Y plane among the X-axis, Y-axis, and Z-axis directions that are mutually orthogonal. The multilayer substrate 2 has a dimension of several mm to several cm in the X-axis and Y-axis directions and a dimension of several hundred μm in the Z-axis direction that is the thickness direction.

The multilayer substrate 2 is a printed circuit board obtained by laminating five layers, for example, thin insulating resin layers 3 to 7, from a front side 2A to a back side 2B. As an example of the multilayer substrate 2, a resin substrate is used. However, the multilayer substrate 2 may be a ceramic multilayer substrate obtained by laminating insulating ceramic layers or a low temperature co-fired ceramic multilayer substrate (LTCC multilayer substrate).

The front-side antenna portion 8 includes a front-side radiation element 9, a front-side ground layer 10, and a front-side feed line 13.

Figure 2:
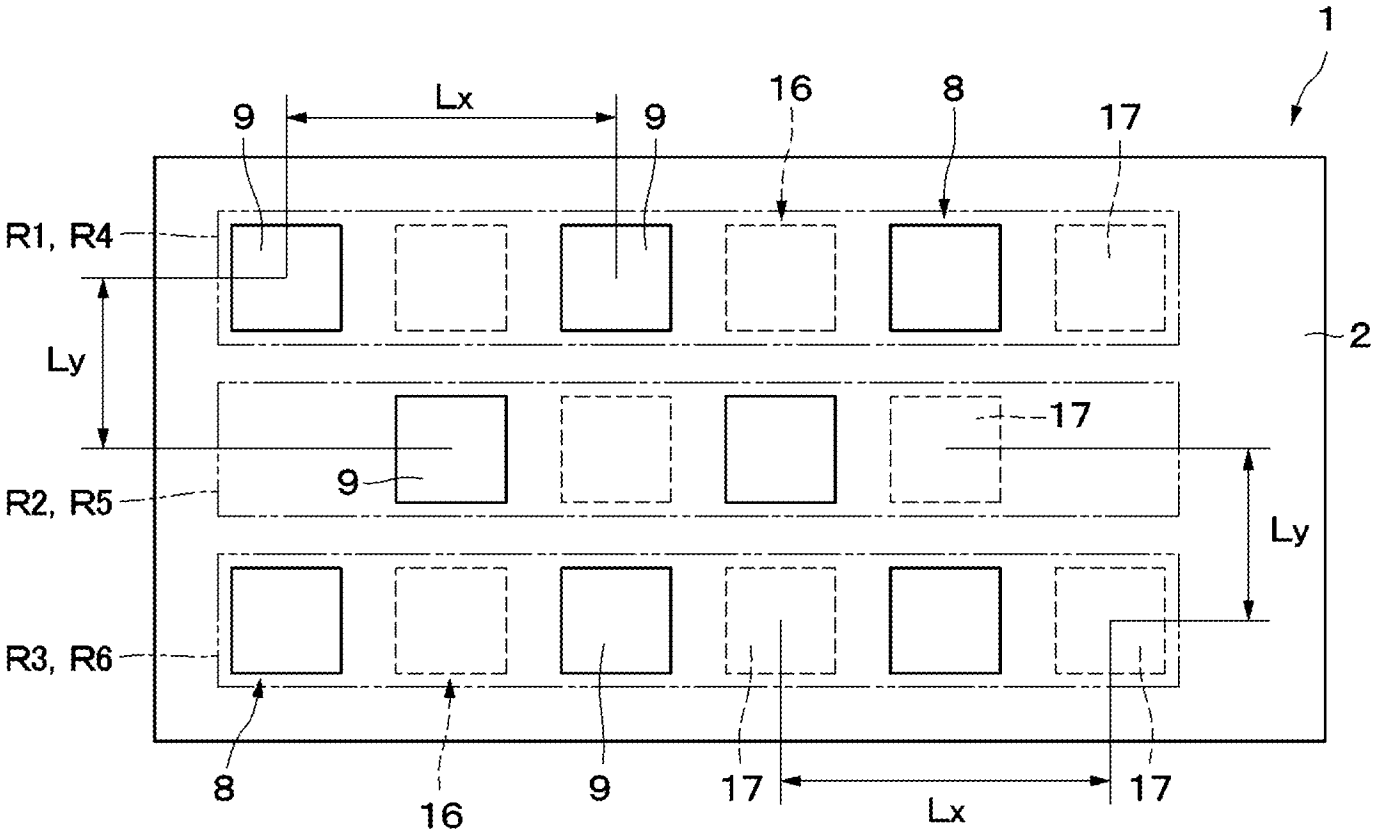
FIG. 2 is a plan view illustrating the positional relationship between a front-side radiation element in a front-side antenna portion and a back-side radiation element in a back-side antenna portion.
Figure 3:
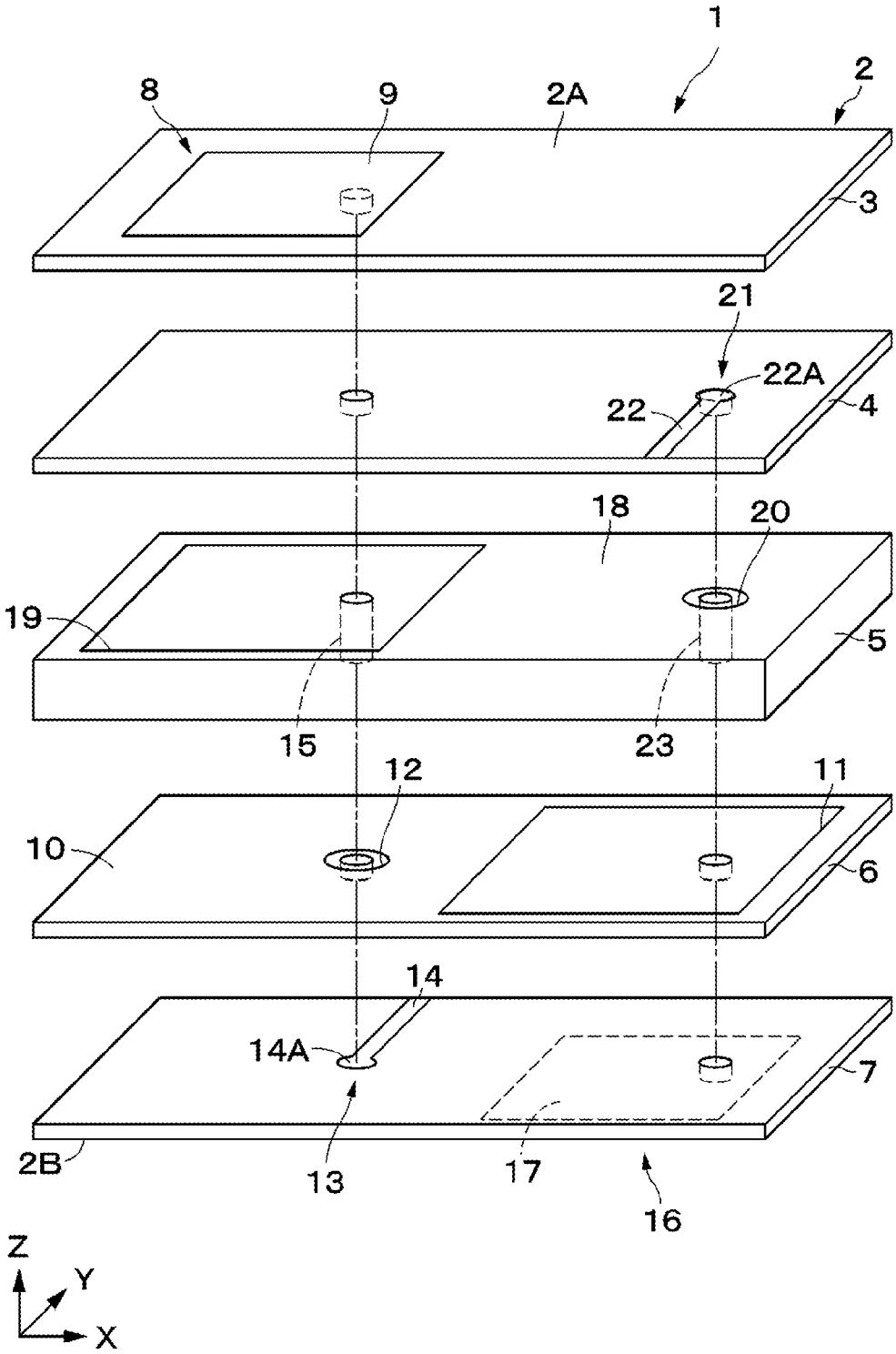
FIG. 3 is an enlarged exploded perspective view of the front-side antenna portion and the back-side antenna portion illustrated in FIG. 1.
Figure 4:
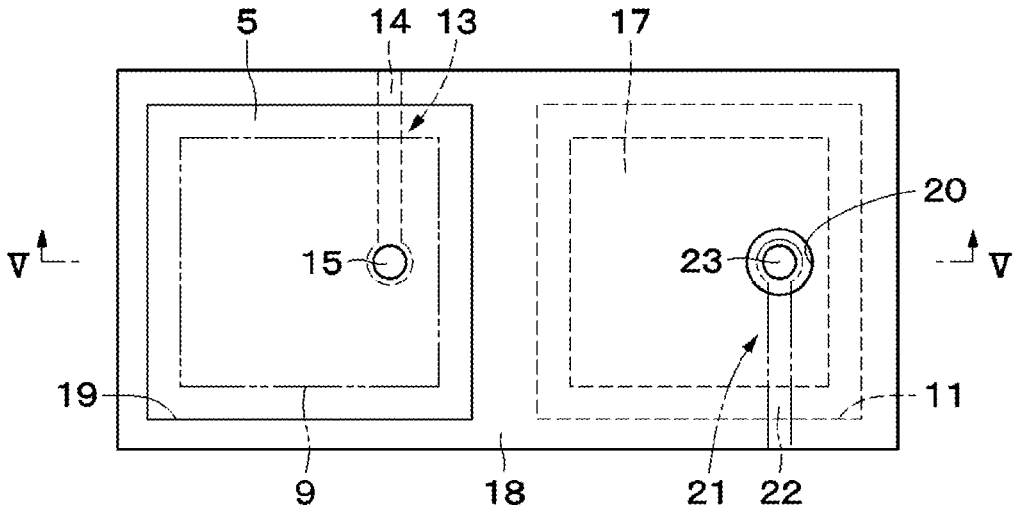
FIG. 4 is a plan view of a back-side ground layer illustrated in FIG. 3.
Figure 5:
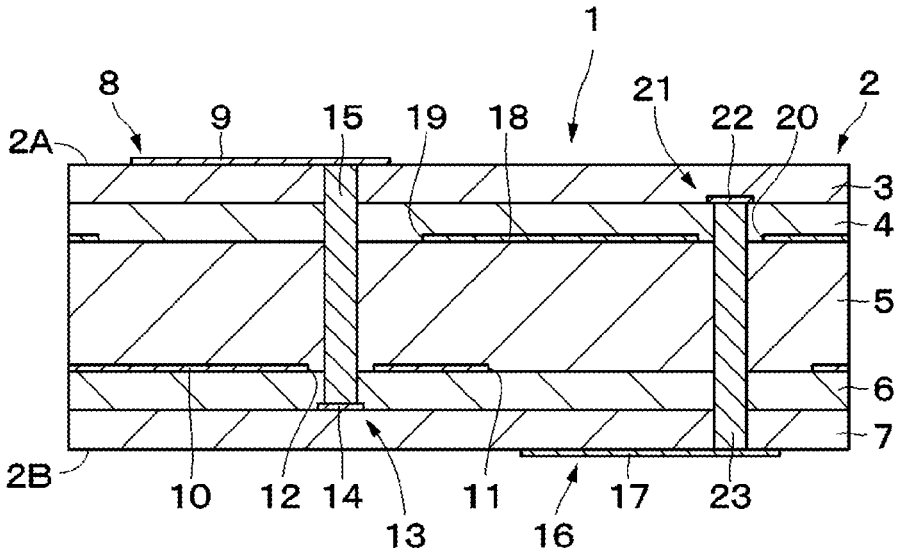
FIG. 5 is a cross-sectional view of the front-side antenna portion and the back-side antenna portion taken along the arrow V-V illustrated in FIG. 4.
Figure 6:
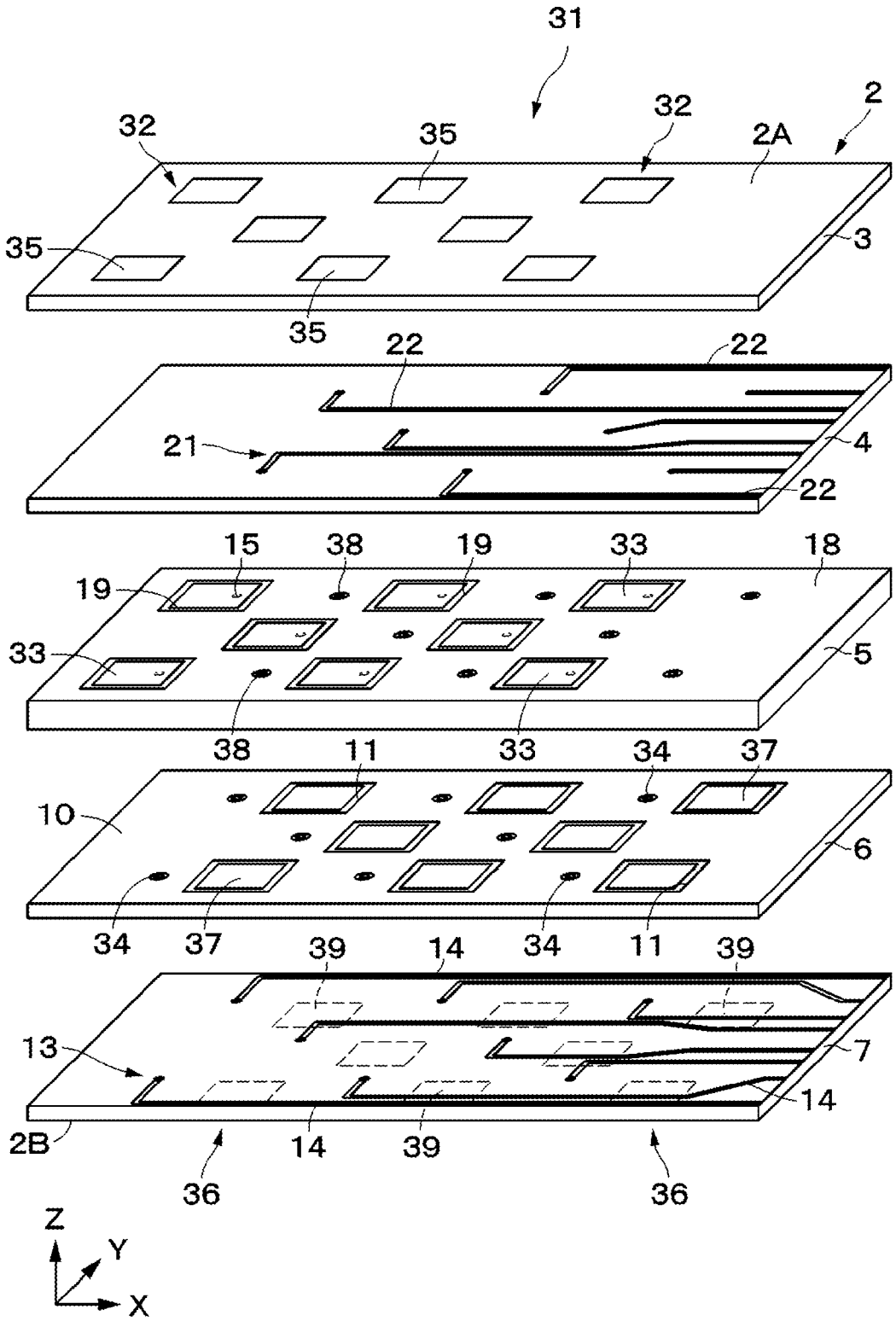
FIG. 6 is an exploded perspective view of an array antenna according to a second embodiment of the present disclosure.
Figure 7:
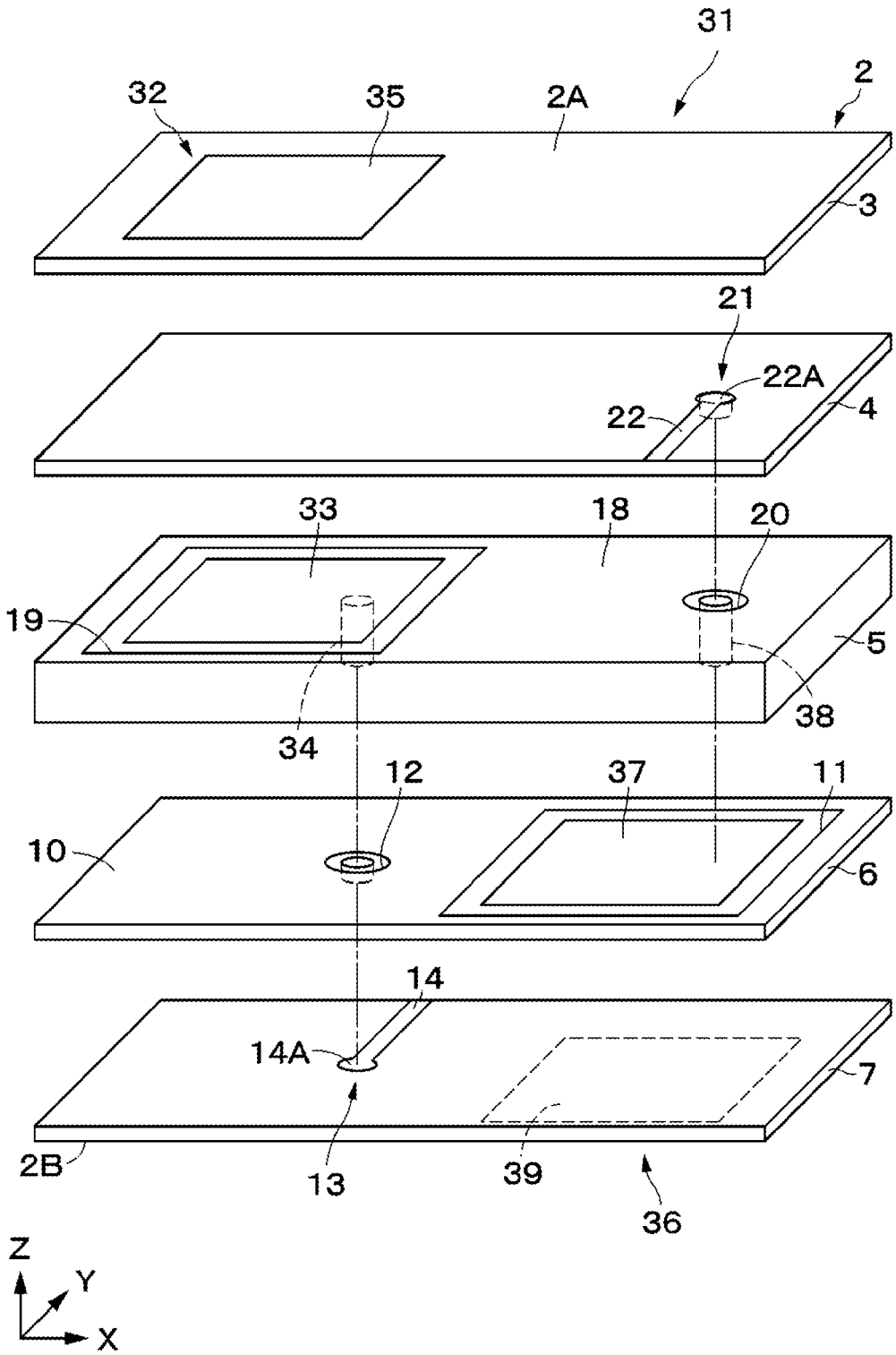
FIG. 7 is an enlarged exploded perspective view of a front-side antenna portion and a back-side antenna portion illustrated in FIG. 6.

The number of front-side radiation elements 9 disposed on the front side 2A of the multilayer substrate 2, that is, the surface of the resin layer 3, is, for example, eight. The front-side radiation element 9 is formed as a substantially rectangular conductor pattern and has a dimension of several hundred μm to several mm in the X-axis and Y-axis directions. The dimension of the front-side radiation element 9 in the X-axis direction is set so that an electrical length is equal to, for example, the one-half wavelength of a high-frequency signal RF to be fed. As illustrated in FIG. 2, the eight front-side radiation elements 9 are disposed at regular intervals in the X-axis direction, so that a first arrangement R1, a second arrangement R2, and a third arrangement R3 are made in three columns in the Y-axis direction.

The distance dimension (gap) between the centers of the adjacent front-side radiation elements 9 in the first arrangement R1 and the third arrangement R3 are set to Lx in the X-axis direction and 2×Ly in the Y-axis direction. The front-side radiation elements 9 in the first arrangement R1 and the third arrangement R3 are therefore arranged in a matrix. Each of the front-side radiation elements 9 in the second arrangement R2 is disposed in the center of the front-side radiation elements 9 in the first arrangement R1 and the third arrangement R3 arranged in a matrix. The X-axis direction distance dimension (gap) between the centers of the adjacent front-side radiation elements 9 in the second arrangement R2 is Lx, and the Y-axis direction distance dimension (gap) between the centers of the front-side radiation elements 9 in the first arrangement R1 and the second arrangement R2 and in the second arrangement R2 and the third arrangement R3 is Ly. As a result, the eight front-side radiation elements 9 are arranged in a staggered pattern on the front side 2A of the multilayer substrate 2. The front-side radiation element 9 is formed with a conductive thin film such as a copper or silver film. The front-side radiation elements 9 do not necessarily have to be disposed on the surface of the resin layer 3 and may be disposed in the resin layer 3 near the front side 2A of the multilayer substrate 2 on the condition that the radiation of waves is not blocked.

As illustrated in FIGS. 1 to 5, the front-side ground layer 10 is formed between the resin layers 5 and 6 to face the front-side radiation elements 9 and cover the substantially entire surface of the resin layer 6. The front-side ground layer 10 is therefore formed between the center of the multilayer substrate 2 in the thickness direction (Z-axis direction) and the back side 2B of the multilayer substrate 2. The front-side ground layer 10 has front-side openings 11 larger than projection regions defined by vertically projecting back-side radiation elements 17 to be described later onto the front-side ground layer 10. In the front-side ground layer 10, openings to be a front-side via formation portion 12 used to form front-side vias 15 are provided. The diameter of the front-side via formation portion 12 is larger than the inner diameter of the front-side via 15. The front-side via 15 and the front-side ground layer 10 are therefore insulated by the clearance between the front-side via 15 and the front-side via formation portion 12. The front-side ground layer 10 is formed with a conductive thin film such as a copper or silver film and is connected to the ground.

The front-side feed line 13 is, for example, a microstrip line, and includes a narrow strip line 14 provided between the resin layers 6 and 7 and the front-side ground layer 10. An end portion 14A of the strip line 14 is placed to be located in the front-side radiation element 9 when being vertically projected onto the front-side radiation element 9 and to be located at the substantially center of the front-side via formation portion 12 when being vertically projected onto the front-side ground layer 10. The end portion 14A is electrically connected to the front-side radiation element 9 via the front-side via 15 that passes through the resin layers 3 to 6 and extends in the Z-axis direction through the front-side via formation portion 12 and a back-side opening 19 to be described later. There are a plurality of strip lines 14. Each of the front-side radiation elements 9 is electrically connected to corresponding one of the strip lines 14. The front-side via 15 is a columnar conductor obtained by providing a through-hole having an inner diameter of several ten to several hundred μm and filling the through-hole with a conductive material such as copper or silver. The front-side via 15 is connected to the some point of the front-side radiation element 9 along the X-axis direction which is a feeding point and is not the center of the front-side radiation element 9.

As a result, the front-side antenna portion 8 that is a patch antenna is formed with the front-side radiation element 9, the front-side ground layer 10, and the front-side feed line 13. In the multilayer substrate 2, the front-side antenna portions 8 that are eight patch antennas are arranged in a staggered pattern.

The back-side antenna portion 16 includes the back-side radiation element 17, a back-side ground layer 18, and a back-side feed line 21.

The number of the back-side radiation elements 17 disposed on the back side 2B of the multilayer substrate 2, that is, the undersurface of the resin layer 7, is, for example, eight. The back-side radiation element 17 is formed as a substantially rectangular conductor pattern and has a dimension of several hundred μm to several mm in the X-axis and Y-axis directions. The dimension of the back-side radiation element 17 in the X-axis direction is set so that an electrical length is equal to, for example, the one-half wavelength of the high-frequency signal RF to be fed. The back-side radiation element 17 is placed so as not to overlap the front-side radiation element 9 when the front-side radiation element 9 is vertically projected onto the undersurface of the resin layer 7. As illustrated in FIG. 2, the eight back-side radiation elements 17 are disposed at regular intervals in the X-axis direction, so that a fourth arrangement R4, a fifth arrangement R5, and a sixth arrangement R6 are made in three columns in the Y-axis direction.

The distance dimension (gap) between the centers of the adjacent back-side radiation elements 17 in the fourth arrangement R4 and the sixth arrangement R6 is set to Lx in the X-axis direction and 2×Ly in the Y-axis direction. The back-side radiation elements 17 in the fourth arrangement R4 and the sixth arrangement R6 are therefore arranged in a matrix. Each of the back-side radiation elements 17 in the fifth arrangement R5 is disposed in the center of the back-side radiation elements 17 in the fourth arrangement R4 and the sixth arrangement R6 arranged in a matrix. The X-axis direction distance dimension (gap) between the centers of the adjacent back-side radiation elements 17 in the fifth arrangement R5 is Lx, and the Y-axis direction distance dimension (gap) between the centers of the back-side radiation elements 17 in the fourth arrangement R4 and the fifth arrangement R5 and in the fifth arrangement R5 and the sixth arrangement R6 is Ly. As a result, the eight back-side radiation elements 17 are arranged in a staggered pattern. The back-side radiation element 17 is formed with a conductive thin film such as a copper or silver film.

The back-side radiation elements 17 do not necessarily have to be disposed on the undersurface of the resin layer 7 and may be disposed in the resin layer 7 near the back side 2B of the multilayer substrate 2 on the condition that the radiation of waves is not blocked. When the first arrangement R1, the second arrangement R2, and the third arrangement R3 of the front-side radiation elements 9 are vertically projected onto the undersurface of the resin layer 7, the extending directions of the first arrangement R1 and the fourth arrangement R4, the extending directions of the second arrangement R2 and the fifth arrangement R5, and the extending directions of the third arrangement R3 and the sixth arrangement R6 may overlap or do not necessarily have to overlap.

As illustrated in FIGS. 1 to 5, the back-side ground layer 18 is formed between the resin layers 4 and 5 to face the back-side radiation elements 17 and cover the substantially entire surface of the resin layer 5. The back-side ground layer 18 is therefore formed between the center of the multilayer substrate 2 in the thickness direction (Z-axis direction) and the front side 2A of the multilayer substrate 2. The back-side ground layer 18 has back-side openings 19 larger than projection regions defined by vertically projecting the front-side radiation elements 9 onto the back-side ground layer 18. In the back-side ground layer 18, openings to be a back-side via formation portion 20 used to form back-side vias 23 to be described later are provided. The aperture diameter of the back-side via formation portion 20 is larger than the inner diameter of the back-side via 23. The back-side via 23 and the back-side ground layer 18 are therefore insulated by the clearance between the back-side via 23 and the back-side via formation portion 20. The back-side ground layer 18 is formed with a conductive thin film such as a copper or silver film and is connected to the ground.

The back-side feed line 21 is, for example, a microstrip line, and includes a narrow strip line 22 provided between the resin layers 3 and 4 and the back-side ground layer 18. An end portion 22A of the strip line 22 is placed to be located in the back-side radiation element 17 when being vertically projected onto the back-side radiation element 17 and to be located at the substantially center of the back-side via formation portion 20 when being vertically projected onto the back-side ground layer 18. The end portion 22A is electrically connected to the back-side radiation element 17 via the back-side via 23 that passes through the resin layers 4 to 7 and extends in the Z-axis direction through the back-side via formation portion 20 and the front-side opening 11. There are a plurality of strip lines 22. Each of the back-side radiation elements 17 is electrically connected to corresponding one of the strip lines 22. The back-side via 23 is a columnar conductor obtained by providing a through-hole having an inner diameter of several ten to several hundred μm and filling the through-hole with a conductive material such as copper or silver. The back-side via 23 is connected to the some point of the back-side radiation element 17 along the X-axis direction which is a feeding point and is not the center of the back-side radiation element 17.

As a result, the back-side antenna portion 16 that is a patch antenna is formed with the back-side radiation element 17, the back-side ground layer 18, and the back-side feed line 21. In the multilayer substrate 2, the back-side antenna portions 16 that are eight patch antennas are arranged in a staggered pattern.

Consequently, in the multilayer substrate 2, the array antenna 1 including the eight front-side antenna portions 8 arranged in a staggered pattern and the eight back-side antenna portions 16 arranged in a staggered pattern is formed. When the distance dimensions Lx and Ly between the adjacent front-side radiation elements 9 and between the adjacent back-side radiation elements 17 is equal to or smaller than the one-half wavelength (λ0/2) of a high-frequency used, mutual coupling between the adjacent front-side radiation elements 9 and mutual coupling between the adjacent back-side radiation elements 17 become stronger and the characteristics of the array antenna are adversely affected. On the other hand, when the distance dimensions Lx and Ly are equal to or larger than one wavelength (λ0), the side lobe in an antenna radiation pattern is increased and an antenna gain in a front direction is reduced. In consideration of these points, it is desired that the distance dimensions Lx and Ly be in the range of one-half wavelength (λ0/2) to one wavelength (λ0) of a high-frequency signal in free space. More specifically, when a millimeter wave in the 60 GHz band is used for the array antenna 1, the distance dimensions Lx and Ly are in the range of approximately 2.5 mm to approximately 5 mm.

Next, the operation of the array antenna 1 according to this embodiment will be described.

When electric power is fed from the front-side feed line 13 toward the front-side radiation element 9, a current flows through the front-side radiation element 9 in the X-axis direction. The front-side antenna portion 8 upwardly emits the high-frequency signal RF from the front side 2A of the multilayer substrate 2 in accordance with the dimension of the front-side radiation element 9 in the X-axis direction, and receives the high-frequency signal RF in accordance with the dimension of the front-side radiation element 9 in the X-axis direction.

When electric power is fed from the back-side feed line 21 to the back-side radiation element 17, a current flows through the back-side radiation element 17 in the X-axis direction. The back-side antenna portion 16 emits the high-frequency signal RF in accordance with the dimension of the back-side radiation element 17 in the X-axis direction, and receives the high-frequency signal RF in accordance with the dimension of the back-side radiation element 17 in the X-axis direction.

By adjusting the phase of the high-frequency signal RF to be supplied to the front-side radiation elements 9 as appropriate, it is possible to supply different signals to the front-side radiation elements 9 via the strip lines 14 and scan beams radiated by the front-side antenna portions 8 in the X-axis direction and the Y-axis direction. By adjusting the phase of the high-frequency signal RF to be supplied to the back-side radiation elements 17 as appropriate, it is possible to supply different signals to the back-side radiation elements 17 via the strip lines 22 and scan beams radiated by the back-side antenna portions 16 in the X-axis direction and the Y-axis direction. Since both sides of the multilayer substrate 2 can have directivity, a radiation angle of a radio wave and a communication region can be increased as compared with a case in which only one side of the multilayer substrate 2 has directivity.

The front-side radiation element 9 and the back-side radiation element 17 are disposed so as not to overlap each other when being vertically projected onto the undersurface of the multilayer substrate 2. It is therefore possible to form the front-side ground layer 10 between the center and the back side 2B of the multilayer substrate 2 and form the back-side ground layer 18 between the center and the front side 2A of the multilayer substrate 2. As a result, it is possible to allow a spacing between the front-side ground layer 10 and the back-side ground layer 18 using the resin layer 5.

In order to achieve wider frequency bands of the front-side antenna portion 8 and the back-side antenna portion 16, the thickness dimension between the front-side radiation element 9 and the front-side ground layer 10 and the thickness dimension between the back-side radiation element 17 and the back-side ground layer 18 need to be large.

It is possible to achieve large thickness dimensions between the front-side radiation element 9 and the front-side ground layer 10 and between the back-side radiation element 17 and the back-side ground layer 18 while adjusting the thickness dimensions of the other layers of the multilayer substrate 2. As a result, it is possible to use antenna space efficiently and provide the small-sized array antenna 1 in which the thickness dimension of the multilayer substrate 2 is small. Since the front-side antenna portions 8 and the back-side antenna portions 16 are arranged in a staggered pattern, the area usage efficiency of the multilayer substrate 2 is increased and the array antenna 1 can be reduced in size.

Electric power is fed to the front-side radiation elements 9 through the front-side feed line 13 and is fed to the back-side radiation elements 17 through the back-side feed line 21. Thus, using microstrip lines commonly used in a high-frequency circuit, feeding can be performed. The array antenna 1 can be easily connected to a high-frequency circuit.

The strip lines 22 of the back-side feed line 21 are provided between the resin layers 3 and 4, and the strip lines 14 of the front-side feed line 13 are provided between the resin layers 6 and 7. Thus, the front-side feed line 13 and the back-side feed line 21, which are microstrip lines, can be provided in the multilayer substrate 2 along with the front-side radiation elements 9, the back-side radiation elements 17, the front-side ground layer 10, and the back-side ground layer 18. Productivity can be increased and variations of characteristics can be reduced.

The front-side antenna portions 8 and the back-side antenna portions 16 are formed in the multilayer substrate 2 obtained by laminating a plurality of resin layers, the resin layers 3 to 7. By disposing the front-side radiation elements 9 of the front-side antenna portions 8 on the resin layer 3 and providing the front-side ground layer 10 on the resin layer 6, they can be easily provided at different positions in the thickness direction of the multilayer substrate 2. By disposing the back-side radiation elements 17 of the back-side antenna portions 16 on the resin layer 7 and providing the back-side ground layer 18 on the resin layer 5, they can be easily provided at different positions in the thickness direction of the multilayer substrate 2.

Next, an array antenna 31 according to a second embodiment of the present disclosure will be described with reference to FIGS. 6 to 9. The feature of the array antenna 31 is that a front-side antenna portion and a back-side antenna portion included in the array antenna 31 are stacked patch antennas including a passive element. In the explanation of the array antenna 31, the same reference numerals are used to identify parts in the array antenna 1 according to the first embodiment so as to avoid repeated explanation.

The array antenna 31 includes the multilayer substrate 2, front-side antenna portions 32, and back-side antenna portions 36.

The front-side antenna portion 32 includes a front-side radiation element 33, the front-side ground layer 10, the front-side feed line 13, and a front-side passive element 35.

The front-side radiation elements 33 are formed between the resin layers 4 and 5 in the same arrangement as that of the front-side radiation elements 9 in the array antenna 1 according to the first embodiment and each have a substantially rectangular shape like the front-side radiation element 9. More specifically, each of the front-side radiation elements 33 is disposed in corresponding one of the back-side openings 19 of the array antenna 1 according to the first embodiment. Each of the front-side radiation elements 33 and the back-side ground layer 18 are insulated by the clearance between them. The difference between the front-side radiation elements 33 and 9 is the plane position in the thickness direction of the multilayer substrate 2. The front-side radiation elements 33 face the front-side ground layer 10 across the resin layer 5. The front-side radiation element 33 and the end portion 14A of the strip line 14 are electrically connected via a front-side via 34 that passes through the resin layers 5 and 6 and extends in the Z-axis direction through the front-side via formation portion 12.

Figure 8:
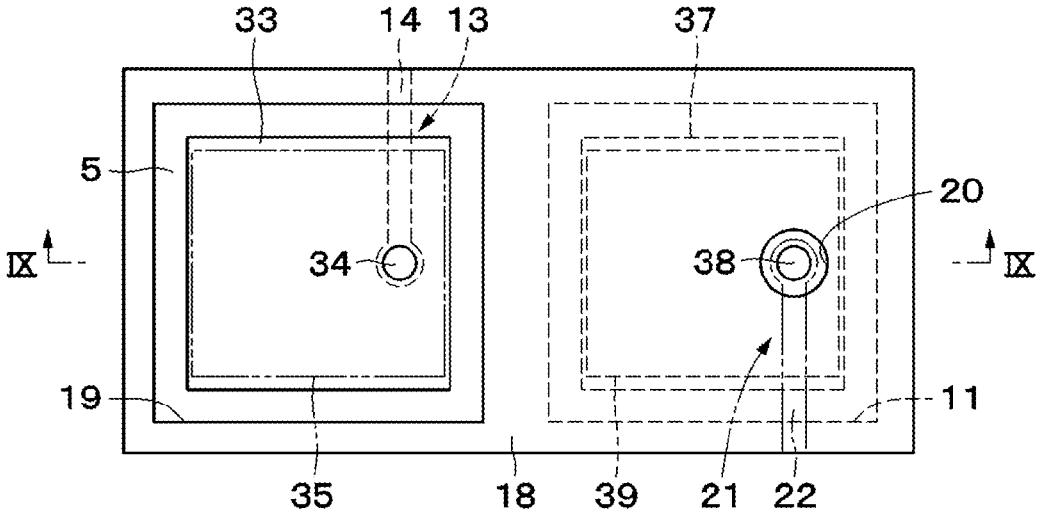
FIG. 8 is a plan view of a front-side radiation element in the front-side antenna portion and a back-side ground layer illustrated in FIG. 7.
Figure 9:
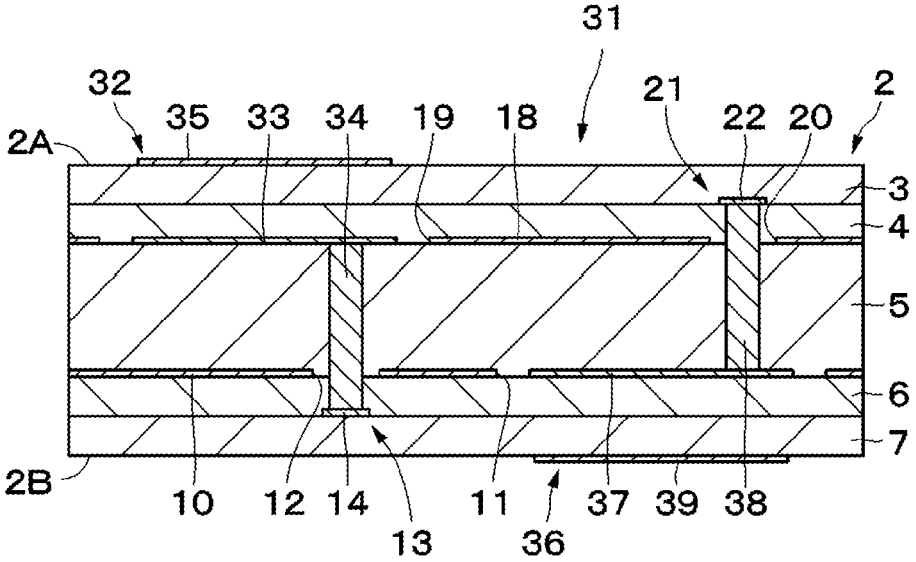
FIG. 9 is a cross-sectional view of the front-side antenna portion and the back-side antenna portion taken along the arrow IX-IX illustrated in FIG. 8.

The front-side passive elements 35 are formed on the front side 2A of the multilayer substrate 2, that is, the surface of the resin layer 3, in the same arrangement as that of the front-side radiation elements 9 in the array antenna 1 according to the first embodiment and each have a substantially rectangular shape like the front-side radiation element 9. The electromagnetic coupling occurs between the front-side passive element 35 and the front-side radiation element 33 that face each other across the resin layers 3 and 4. Referring to FIG. 8, the front-side passive element 35 is smaller than the front-side radiation element 33. The dimensions of the front-side passive element 35 in the X-axis direction and the Y-axis direction may be larger or smaller than those of the front-side radiation element 33. The size relationship between the front-side passive element 35 and the front-side radiation element 33 and the shapes of them are set as appropriate in consideration of the radiation pattern and band of the front-side antenna portion 32.

The electromagnetic coupling occurs between the front-side passive element 35 and the front-side radiation element 33. As a result, the front-side radiation element 33, the front-side ground layer 10, the front-side feed line 13, and the front-side passive element 35 which are included in the front-side antenna portion 32 form a stacked patch antenna. In the multilayer substrate 2, the eight front-side antenna portions 32 are arranged in a staggered pattern.

The back-side antenna portion 36 includes a back-side radiation element 37, the back-side ground layer 18, the back-side feed line 21, and a back-side passive element 39.

The back-side radiation elements 37 are formed between the resin layers 5 and 6 in the same arrangement as that of the back-side radiation elements 17 in the array antenna 1 according to the first embodiment and each have a substantially rectangular shape like the back-side radiation element 17. More specifically, each of the back-side radiation elements 37 is disposed in corresponding one of the front-side openings 11 of the array antenna 1 according to the first embodiment. Each of the back-side radiation elements 37 and the front-side ground layer 10 are insulated by the clearance between them. The difference between the back-side radiation elements 37 and 17 is the plane position in the thickness direction of the multilayer substrate 2. The back-side radiation elements 37 face the back-side ground layer 18 across the resin layer 5. The back-side radiation element 37 and the end portion 22A of the strip line 22 are electrically connected via a back-side via 38 that passes through the resin layers 4 and 5 and extends in the Z-axis direction through the back-side via formation portion 20.

The back-side passive elements 39 are formed on the back side 2B of the multilayer substrate 2, that is, the undersurface of the resin layer 7, in the same arrangement as that of the back-side radiation elements 17 in the array antenna 1 according to the first embodiment and each have a substantially rectangular shape like the back-side radiation element 17. The electromagnetic coupling occurs between the back-side passive element 39 and the back-side radiation element 37 that face each other across the resin layers 6 and 7.

Referring to FIG. 8, the back-side passive element 39 is smaller than the back-side radiation element 37. The dimensions of the back-side passive element 39 in the X-axis direction and the Y-axis direction may be larger or smaller than those of the back-side radiation element 37.

The electromagnetic coupling occurs between the back-side passive element 39 and the back-side radiation element 37. As a result, the back-side radiation element 37, the back-side ground layer 18, the back-side feed line 21, and the back-side passive element 39 which are included in the back-side antenna portion 36 form a stacked patch antenna. In the multilayer substrate 2, the eight back-side antenna portion 36 are arranged in a staggered pattern, and form the array antenna 31 along with the eight front-side antenna portions 32 arranged in a staggered pattern.

The array antenna 31 can obtain an operational effect similar to that of the array antenna 1 according to the first embodiment. Since the front-side antenna portion 32 includes the front-side passive element 35 formed on the surface of the front-side radiation element 33 via the resin layers 3 and 4, two resonant modes (electromagnetic field modes) for different resonant frequencies are generated and the wider frequency band of the front-side antenna portion 32 can be achieved. For similar reasons, the wider frequency band of the back-side antenna portion 36 can also be achieved.

In the second embodiment, the front-side radiation elements 33 and the back-side ground layer 18 are formed on the same layer and the back-side radiation elements 37 and the front-side ground layer 10 are formed on the same layer. However, a radiation element and a ground layer may be on different layers.

Figure 10:
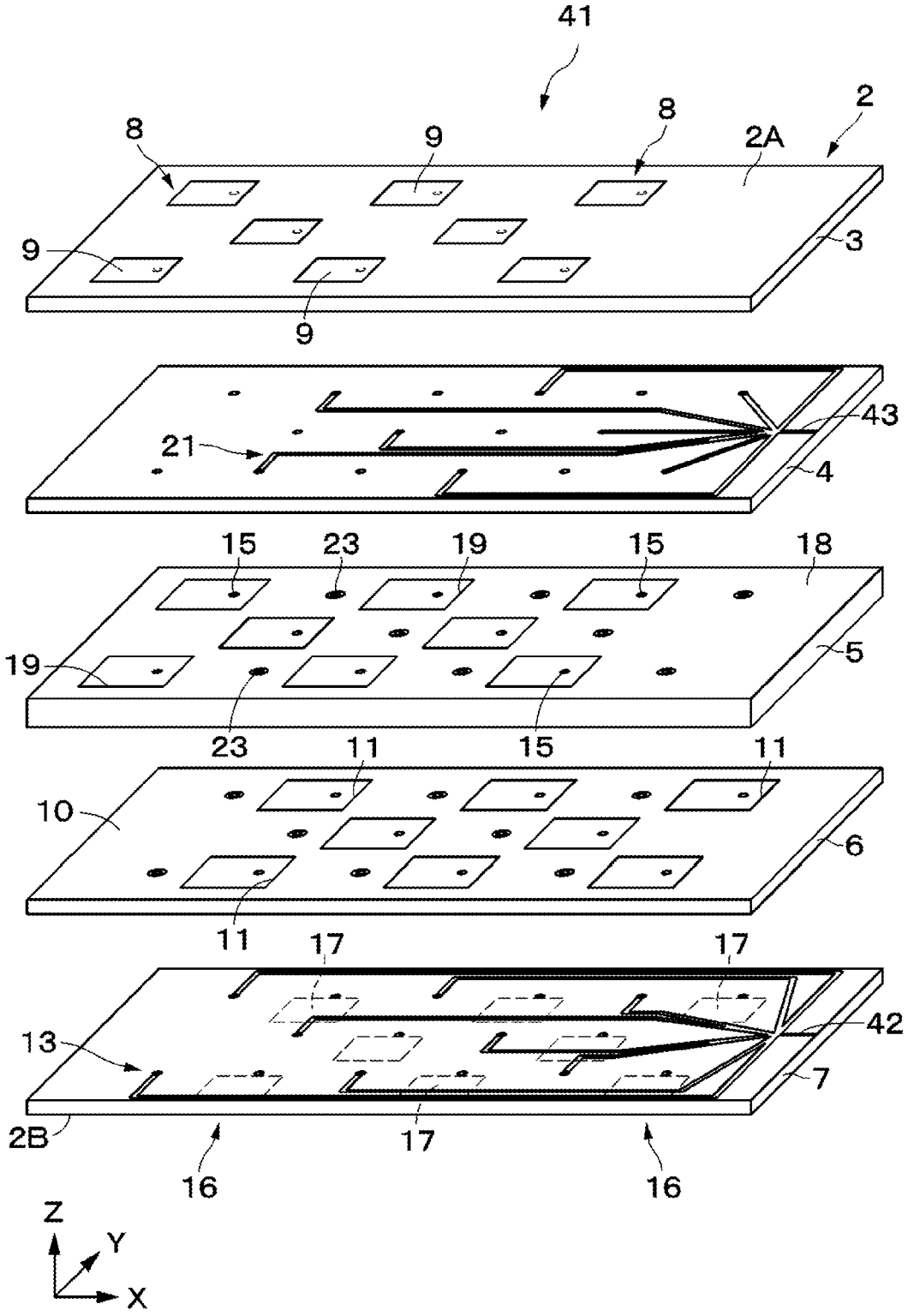
FIG. 10 is an exploded perspective view of an array antenna that is a first modification.
Figure 11:
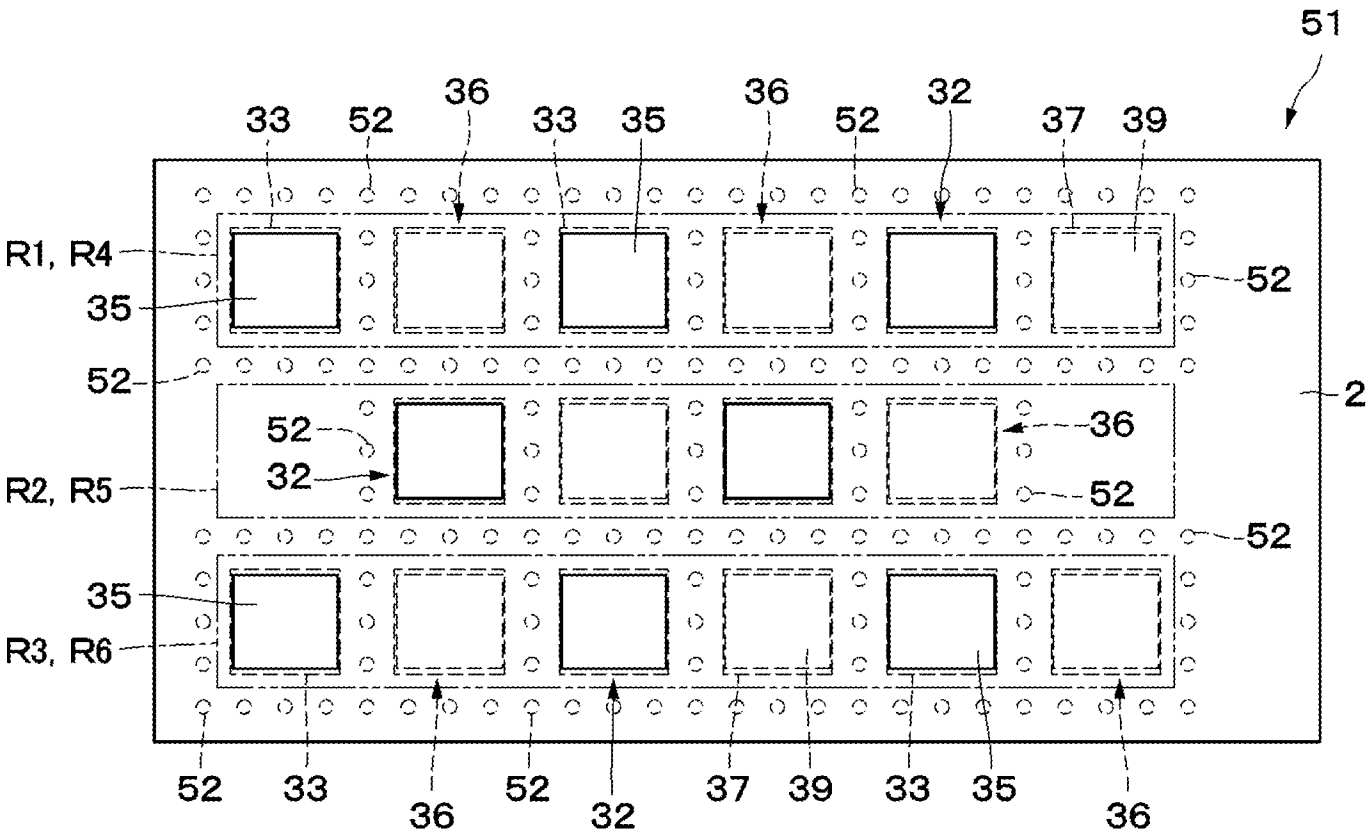
FIG. 11 is a plan view of an array antenna according to a third embodiment of the present disclosure.
Figure 12:
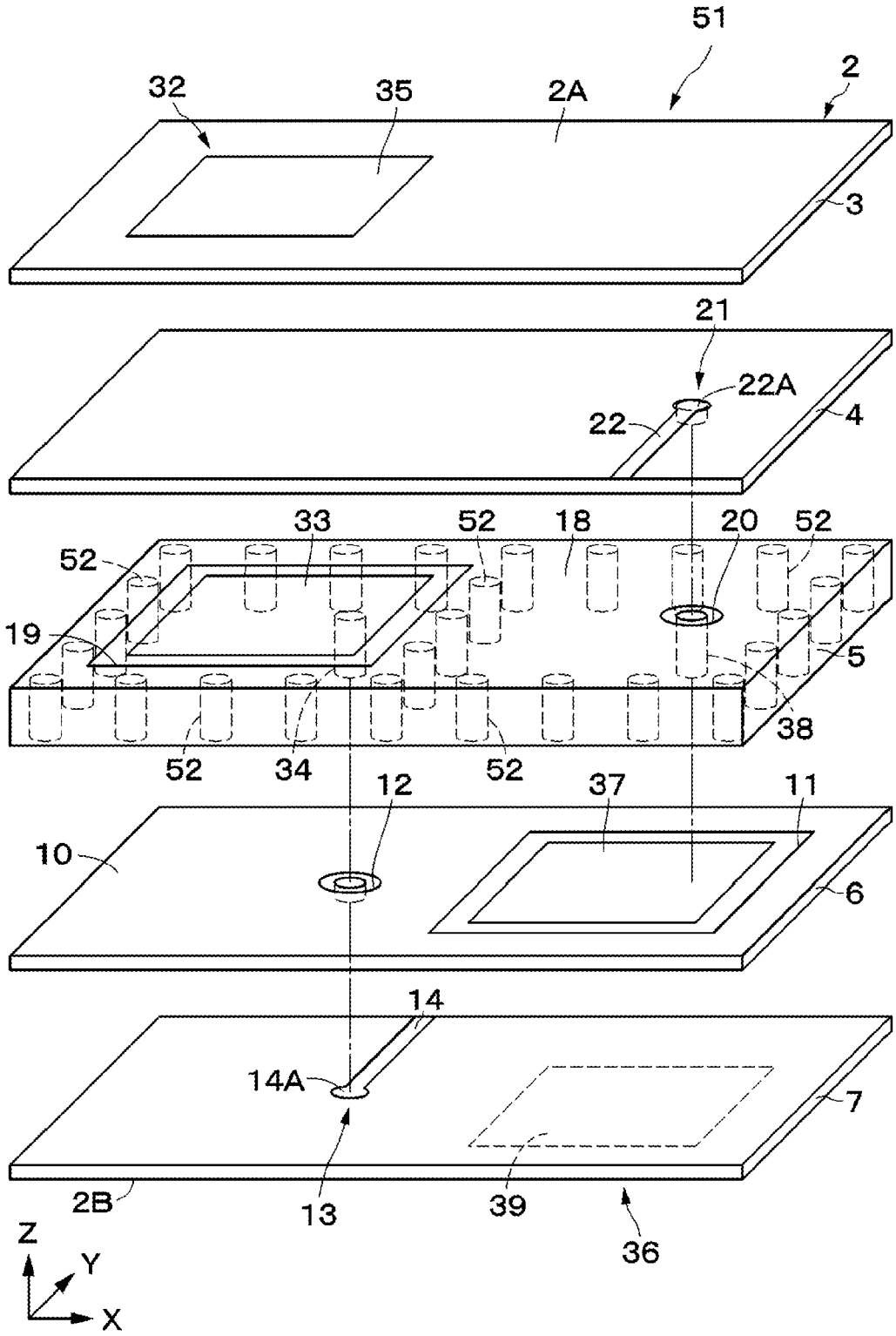
FIG. 12 is an enlarged exploded perspective view of a front-side antenna portion and a back-side antenna portion illustrated in FIG. 11.
Figure 13:
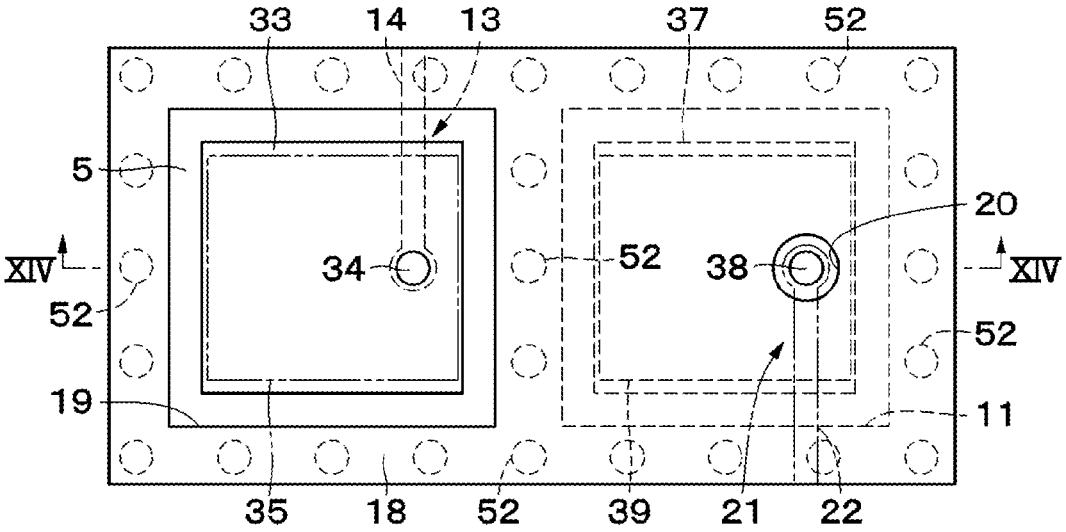
FIG. 13 is a plan view of a front-side radiation element in the front-side antenna portion and a back-side ground layer illustrated in FIG. 12.
Figure 14:
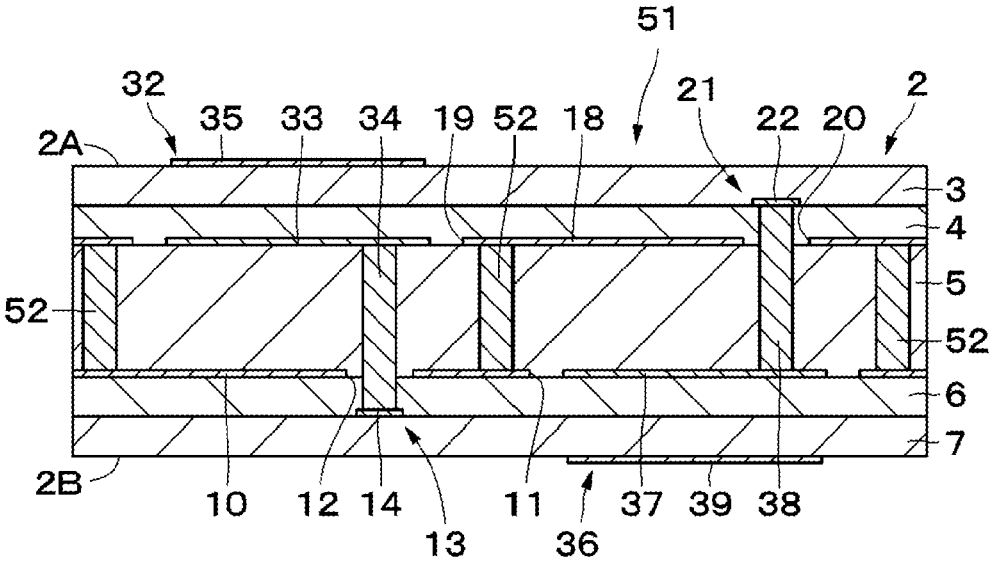
FIG. 14 is a cross-sectional view of the front-side antenna portion and the back-side antenna portion taken along the arrow XIV-XIV illustrated in FIG. 13.

In the array antennas 1 according to the first embodiment and the array antenna 31 according to the second embodiment, a plurality of strip lines, the strip lines 14 and the strip lines 22, are formed. If there is no need to scan a radiation beam in the X-axis direction and the Y-axis direction, a common signal may be supplied to the front-side radiation elements 9 via a strip line 42 having an end portion divided into branches and a common signal may be supplied to the back-side radiation elements 17 via a strip line 43 having an end portion divided into branches like in, for example, an array antenna 41 that is the first modification illustrated in FIG. 10. This configuration of the first modification can be applied to the second embodiment.

Next, an array antenna 51 according to a third embodiment of the present disclosure will be described with reference to FIGS. 11 to 14. The feature of the array antenna 51 is that vias 52 for electrically connecting the front-side ground layer 10 and the back-side ground layer 18 are provided around the front-side radiation elements 33 and the back-side radiation elements 37 in the multilayer substrate 2. In the explanation of the array antenna 51, the same reference numerals are used to identify parts in the array antenna 31 according to the second embodiment so as to avoid repeated explanation.

The array antenna 51 includes the multilayer substrate 2, the front-side antenna portion 32, and the back-side antenna portion 36 like the array antenna 31 according to the second embodiment.

The array antenna 51 according to the third embodiment differs from the array antenna 31 according to the second embodiment in that the vias 52 for electrically connecting the front-side ground layer 10 and the back-side ground layer 18 are provided around the front-side radiation elements 33 and the back-side radiation elements 37 in the multilayer substrate 2.

The via 52 is a columnar conductor obtained by providing a through-hole that passes through the resin layer 5 of the multilayer substrate 2 and has an inner diameter of several ten to several hundred μm and filling the through-hole with a conductive material such as copper or silver. One end of the via 52 is connected to the front-side ground layer 10, and the other end of the via 52 is connected to the back-side ground layer 18. The vias 52 are disposed to surround the front-side radiation elements 33 and the back-side radiation elements 37 when the front-side radiation elements 33 and the back-side radiation elements 37 are vertically projected onto the resin layer 5. The vias 52 are therefore formed in a frame shape surrounding the front-side radiation elements 33 and the back-side radiation elements 37.

The distance dimension between two adjacent ones of the vias 52 is set so that an electrical length is much shorter than the wavelength of the high-frequency signal RF to be fed. More specifically, the distance dimension between two adjacent ones of the vias 52 is set so that an electrical length is shorter than the one-half wavelength of the high-frequency signal RF or is shorter than the one-quarter wavelength of the high-frequency signal RF. As a result, the vias 52 form a conductive wall between the front-side antenna portion 32 and the back-side antenna portion 36.

The array antenna 51 can obtain an operational effect similar to that of the array antenna 31 according to the second embodiment. Since the vias 52 are formed in the multilayer substrate 2 to surround the front-side radiation elements 33 and the back-side radiation elements 37, the vias 52 can serve as a wall between the front-side antenna portion 32 and the back-side antenna portion 36. It is therefore possible to provide the isolation between the front-side antenna portion 32 and the back-side antenna portion 36 in the band of the high-frequency signal RF and prevent mutual interference between the high-frequency signals RF in the front-side antenna portion 32 and the back-side antenna portion 36 even in a case where the front-side antenna portion 32 and the back-side antenna portion 36 are closely disposed. In addition, since the via 52 electrically connects the front-side ground layer 10 and the back-side ground layer 18, the potentials of the front-side ground layer 10 and the back-side ground layer 18 can be stabilized.

Figure 15:
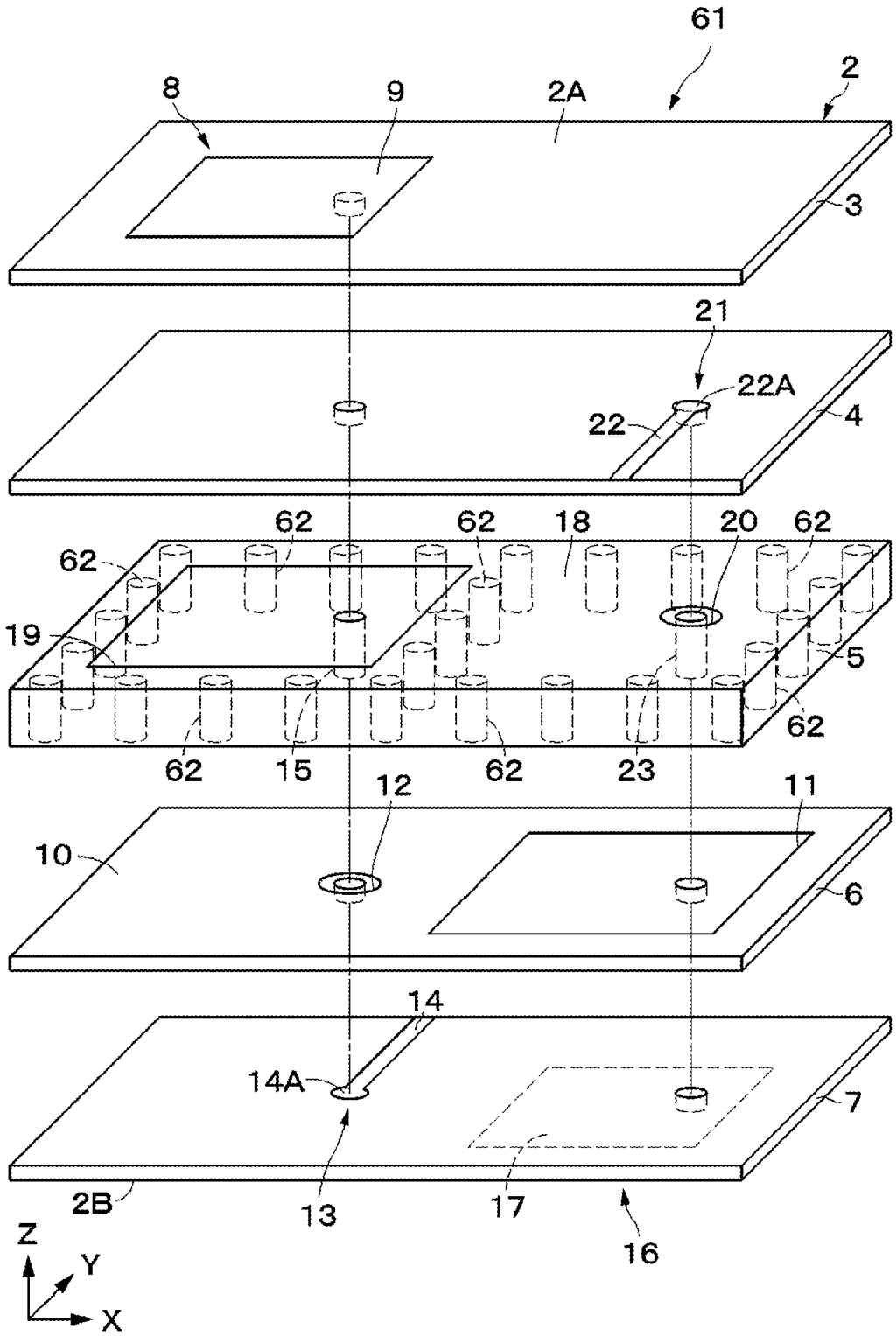
FIG. 15 is an exploded perspective view of an array antenna that is a second modification at a position similar to that in FIG. 12.

In the third embodiment, the vias 52 for electrically connecting the front-side ground layer 10 and the back-side ground layer 18 are formed to surround the front-side radiation elements 33 according to the second embodiment and the back-side radiation elements 37 according to the second embodiment. The present disclosure is not limited to this configuration. For example, like in an array antenna 61 that is a second modification illustrated in FIG. 15, vias 62 for electrically connecting the front-side ground layer 10 and the back-side ground layer 18 may be formed to surround the front-side radiation elements 9 according to the first embodiment and the back-side radiation elements 17 according to the first embodiment.

A conductor connection portion is formed with the vias 52 in the third embodiment, but may be formed with, for example, a conductor film. This configuration can be applied to the second modification.

In the above-described embodiments, an array antenna (1, 31, and 51) includes eight front-side antenna portions (8 and 32) and eight back-side antenna portions (16 and 36). The numbers of the front-side antenna portions and the back-side antenna portions may be one, in the range of two to seven, or nine or more. The numbers of the front-side antenna portions and the back-side antenna portions do not necessarily have to be the same and may be different. This configuration can also be applied to the first and second modifications.

The front-side antenna portions 8 and 32 and the back-side antenna portions 16 and 36 are disposed on a plane extending in the X-axis direction and the Y-axis direction in the above-described embodiments, but may be arranged in a straight line. This configuration can also be applied to the first and second modifications.

The direction of flow of a current through the front-side radiation elements 9 and 33 in the front-side antenna portions 8 and 32 and the direction of flow of a current through the back-side radiation elements 17 and 37 in the back-side antenna portions 16 and 36 are the X-axis direction in the above-described embodiments, but may be different directions. That is, the front-side antenna portion and the back-side antenna portion may have the same polarization or different polarizations. This configuration can also be applied to the first and second modifications.

The front-side feed line 13 and the back-side feed line 21 are microstrip lines in the above-described embodiments, but may be coplanar lines or triplate lines (strip lines). This configuration can also be applied to the first and second modifications.

In the above-described embodiments, the multilayer substrate 2 obtained by laminating five insulating layers, the resin layers 3 to 7, is used. The number of insulating layers may be changed as needed.

The distance dimensions Lx and Ly are set when a millimeter wave in the 60 GHz band is used for the array antenna 1. A millimeter wave or a microwave in another frequency band may be used. In this case, the distance dimensions Lx and Ly are set in accordance with a wavelength in the frequency band.

In the above-described embodiments, a patch antenna is used. However, a linear antenna, such as a dipole antenna and a monopole antenna, or a slot antenna having a configuration similar to the above-described configurations can obtain an effect similar to that according to the present disclosure.

REFERENCE SIGNS LIST

1, 31, 41, 51, and 61 array antenna
2 multilayer substrate (substrate)
3 to 7 resin layer (insulating layer)
8 and 32 front-side antenna portion
9 and 33 front-side radiation element
10 front-side ground layer
13 front-side feed line
14, 22, 42, and 43 strip line
16 and 36 back-side antenna portion
17,37 back-side radiation element
18 back-side ground layer
21 back-side feed line
35 front-side passive element
39 back-side passive element
52 and 62 via (conductor connection portion)

The invention claimed is:

1. An array antenna comprising:
a multilayer substrate; and
a plurality of antennas disposed on the substrate,
wherein one of an adjacent two of the plurality of antennas comprises a front-side antenna portion that comprises a front-side radiation element on or near a front side of the substrate,
wherein the other one of the adjacent two of the plurality of antennas comprises a back-side antenna portion that comprises the back-side radiation element on or near a back side of the substrate,
wherein the front-side radiation element in the front-side antenna portion and the back-side radiation element in the back-side antenna portion are arranged so as not to overlap each other when being vertically projected onto the back side of the substrate,
wherein a front-side ground layer facing the front-side radiation element in the front-side antenna portion is provided on, or closer to the back side of the substrate than the front side of the substrate, and
wherein a back-side ground layer facing the back-side radiation element in the back-side antenna portion is provided on, or closer to the front side of the substrate than the back side of the substrate.

2. The array antenna according to claim 1, wherein a conductor connection portion that electrically connects the front-side ground layer and the back-side ground layer is disposed in the multilayer substrate and the conductor connection portion surrounds the front-side radiation element and the back-side radiation element.

3. The array antenna according to claim 1,
wherein the front-side antenna portion includes a front-side passive element laminated on a front side of the front-side radiation element via an insulating layer, and
wherein the back-side antenna portion includes a back-side passive element laminated on a back side of the back-side radiation element via an insulating layer.

4. The array antenna according to claim 1, wherein, when the front-side radiation element in the front-side antenna portion that is one of the adjacent two of the plurality of antennas and the back-side radiation element in the back-side antenna portion that is the other one of the adjacent two of the plurality of antennas are vertically projected onto the back side of the substrate, a gap between the front-side radiation element and the back-side radiation element is set to a predetermined value based on frequencies to be radiated.

5. The array antenna according to claim 1, wherein, when the front-side radiation elements in the front-side antenna portions each of which is one of the adjacent two of the plurality of antennas and the back-side radiation elements in the back-side antenna portions each of which is the other one of the adjacent two of the plurality of antennas are vertically projected onto the back side of the substrate, the front-side radiation elements are arranged in a staggered pattern and the back-side radiation elements are arranged in a staggered pattern.

* * * * *